US010038230B2

(12) United States Patent
Cohen

(10) Patent No.: US 10,038,230 B2
(45) **Date of Patent: *Jul. 31, 2018**

(54) WIDEBAND ELECTROMAGNETIC CLOAKING SYSTEMS

(71) Applicant: Fractal Antenna Systems, Inc., Bedford, MA (US)

(72) Inventor: Nathan Cohen, Belmont, MA (US)

(73) Assignee: Fractal Antenna Systems, Inc., Bedford, MA (US)

( * ) Notice: Subject to any disclaimer, the term of this patent is extended or adjusted under 35 U.S.C. 154(b) by 596 days.

This patent is subject to a terminal disclaimer.

(21) Appl. No.: 14/598,883

(22) Filed: Jan. 16, 2015

(65) Prior Publication Data

US 2015/0130563 A1 May 14, 2015

Related U.S. Application Data

(63) Continuation of application No. 13/594,146, filed on Aug. 24, 2012, now Pat. No. 8,937,579, which is a continuation of application No. 12/547,104, filed on Aug. 25, 2009, now Pat. No. 8,253,639.

(60) Provisional application No. 61/189,966, filed on Aug. 25, 2008.

(51) Int. Cl.

| | |
|---|---|
| ***H01Q 15/02*** | (2006.01) |
| ***H01P 1/20*** | (2006.01) |
| ***H01Q 21/20*** | (2006.01) |

(52) U.S. Cl.

CPC ..... *H01P 1/20* (2013.01); *H01Q 21/205* (2013.01)

(58) Field of Classification Search

CPC ..... H01Q 1/20; H01Q 19/06; H01P 1/20
USPC ..... 343/753, 909, 910, 754
See application file for complete search history.

(56) References Cited

U.S. PATENT DOCUMENTS

| | | | | |
|---|---|---|---|---|
| 4,638,324 | A | 1/1987 | Hannan | |
| 5,208,603 | A | 5/1993 | Yee | |
| 5,471,224 | A | 11/1995 | Barkeshli | |
| 5,629,266 | A | 5/1997 | Lithgow et al. | |
| 5,714,961 | A | 2/1998 | Kot et al. | |
| 6,473,048 | B1 * | 10/2002 | Diaz | H01Q 1/42 343/753 |
| 8,253,639 | B2 | 8/2012 | Cohen | |
| 8,488,247 | B2 * | 7/2013 | Cai | F41H 3/00 359/642 |
| 9,024,831 | B2 * | 5/2015 | Wang | H01Q 1/241 343/700 MS |

* cited by examiner

*Primary Examiner* — Peguy Jean Pierre
(74) *Attorney, Agent, or Firm* — McDermott Will & Emery LLP

(57) ABSTRACT

Arrangement of resonators in an aperiodic configurations are described, which can be used for electromagnetic cloaking of objects. The overall assembly of resonators, as structures, do not all repeat periodically and at least some of the resonators are spaced such that their phase centers are separated by more than a wavelength. The arrangements can include resonators of several different sizes and/or geometries arranged so that each size or geometry corresponds to a moderate or high "Q" response that resonates within a specific frequency range, and that arrangement within that specific grouping of akin elements is periodic in the overall structure. The relative spacing and arrangement of groupings can be defined by self similarity and origin symmetry.

2 Claims, 4 Drawing Sheets

WIDEBAND ELECTROMAGNETIC CLOAKING SYSTEMS

RELATED APPLICATION

This application is a Continuation Application of U.S. patent application Ser. No. 13/594,146, filed on Aug. 24, 2012 and entitled "Wideband Electromagnetic Cloaking Systems," which is a Continuation of U.S. patent application Ser. No. 12/547,104, filed Aug. 25, 2009 and entitled "Wideband Electromagnetic Cloaking Systems," which claims priority to U.S. Provisional Patent Application No. 61/189,966, filed 25 Aug. 2008 and entitled "Method and Apparatus for Wideband Electromagnetic Cloaking, Negative Refractive Index Lensing and Metamaterial Applications," the entire contents of all of which applications are incorporated herein by reference.

BACKGROUND

Much time and effort has been devoted to the quest for so-called invisibility machines. Beyond science fiction, however, there has been little if any real progress toward this goal.

Materials with negative permittivity and permeability leading to negative index of refraction were theorized by Russian noted physicist Victor Veselago in his seminal paper in *Soviet Physics* USPEKHI, 10, 509 (1968). Since that time, metamaterials have been developed that produce negative index of refraction, subject to various constraints. Such materials are artificially engineered micro/nanostructures that, at given frequencies, show negative permeability and permittivity. Metamaterials have been shown to produce narrow band, e.g., typically less than 5%, response such as bent-back lensing. Such metamaterials produce such a negative-index effect by utilizing a closely-spaced periodic lattice of resonators, such as split-ring resonators, that all resonate. Previous metamaterials provide a negative index of refraction when a sub-wavelength spacing is used for the resonators.

In the microwave regime, certain techniques have been developed to utilize radiation-absorbing materials or coatings to reduce the radar cross section of airborne missiles and vehicles. While such absorbing materials can provide an effective reduction in radar cross section, these results are largely limited to small ranges of electromagnetic radiation.

SUMMARY

Embodiments of the present disclosure can provide techniques, including systems and/or methods, for cloaking objects at certain wavelengths/frequencies or over certain wavelength/frequency ranges (bands). Such techniques can provide an effective electromagnetic lens and/or lensing effect for certain wavelengths/frequencies or over certain wavelength/frequency ranges (bands).

The effects produced by such techniques can include cloaking or so-called invisibility of the object(s) at the noted wavelengths or bands. Representative frequencies of operation can include, but are not limited to, those over a range of 500 MHz to 1.3 GHz, though others may of course be realized. Operation at other frequencies, including for example those of visible light, infrared, ultraviolet, and as well as microwave EM radiation, e.g., K, Ka, X-bands, etc. may be realized, e.g., by appropriate scaling of dimensions and selection of shape of the resonator elements.

Exemplary embodiments of the present disclosure can include a novel arrangement of resonators in an aperiodic configuration or lattice. The overall assembly of resonators, as structures, do not all repeat periodically and at least some of the resonators are spaced such that their phase centers are separated by more than a wavelength. The arrangements can include resonators of several different sizes and/or geometries arranged so that each size or geometry ("grouping") corresponds to a moderate or high "Q" (that is moderate or low bandwidth) response that resonates within a specific frequency range, and that arrangement within that specific grouping of akin elements is periodic in the overall structure—even though the structure as a whole is not an entirely periodic arrangement of resonators. The relative spacing and arrangement of groupings (at least one for each specific frequency range) can be defined by self similarity and origin symmetry, where the "origin" arises at the center of a structure (or part of the structure) individually designed to have the wideband metamaterial property.

For exemplary embodiments, fractal resonators can be used for the resonators in such structures because of their control of passbands, and smaller sizes compared to non-fractal based resonators. Their benefit arises from a size standpoint because they can be used to shrink the resonator (s), while control of passbands can reduce or eliminates issues of harmonic passbands that would resonate at frequencies not desired.

It should be understood that other embodiments of wideband electromagnetic resonator or cloaking systems and methods according to the present disclosure will become readily apparent to those skilled in the art from the following detailed description, wherein exemplary embodiments are shown and described by way of illustration. The systems and methods of the present disclosure are capable of other and different embodiments, and details of such are capable of modification in various other respects. Accordingly, the drawings and detailed description are to be regarded as illustrative in nature and not as restrictive.

BRIEF DESCRIPTION OF THE DRAWINGS

Aspects of the disclosure may be more fully understood from the following description when read together with the accompanying drawings, which are to be regarded as illustrative in nature, and not as limiting. The drawings are not necessarily to scale, emphasis instead being placed on the principles of the disclosure. In the drawings.

Figure 1:
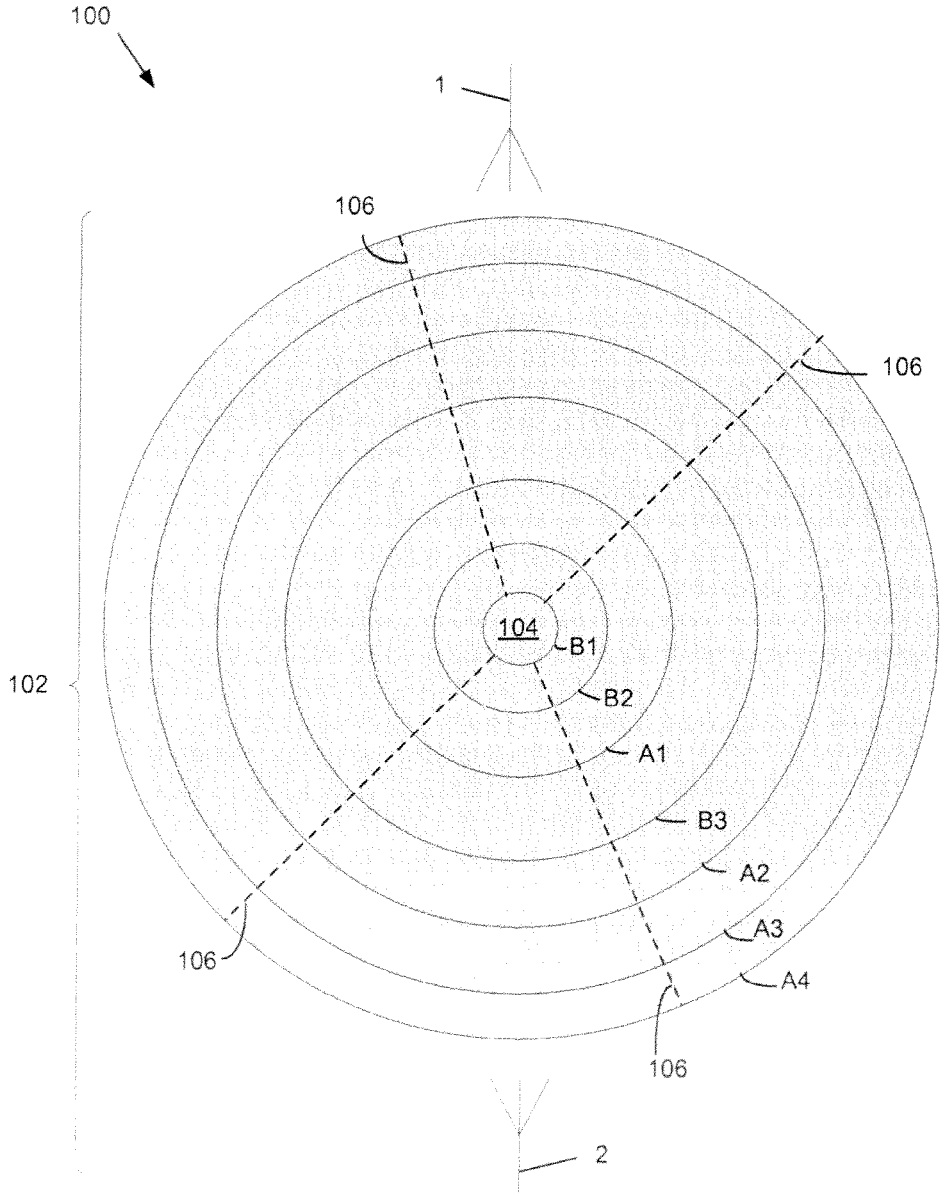
FIG. 1 depicts a diagrammatic plan view of a resonator cloaking system utilizing a number of cylindrical shells, in accordance with exemplary embodiments of the present disclosure.

While certain embodiments depicted in the drawings, one skilled in the art will appreciate that the embodiments depicted are illustrative and that variations of those shown, as well as other embodiments described herein, may be envisioned and practiced within the scope of the present disclosure.

DETAILED DESCRIPTION

The present disclosure is directed to novel arrangements of resonators useful for obscuring or hiding objects at given bands of electromagnetic radiation. Embodiments of the present disclosure can provide techniques, including systems and/or methods, for hiding or obscuring objects at certain wavelengths/frequencies or over certain wavelength/frequency ranges or bands. Such techniques can provide an effective electromagnetic lens and/or lensing effect for certain wavelengths/frequencies or over certain wavelength/frequency ranges or bands. The effects produced by such techniques can include cloaking or so-called invisibility of the object(s) at the noted wavelengths or bands.

Representative frequencies of operation can include, but are not limited to, those over a range of about 500 MHz to about 1.3 GHz, though others may of course be realized. Operation at other frequencies, including for example those of visible light, infrared, ultraviolet, and as well as microwave EM radiation, e.g., K, Ka, X-bands, etc. may be realized, e.g., by appropriate scaling of dimensions and selection of shape of the resonator elements.

Embodiments of the present disclosure include arrangement of resonators or resonant structures in an aperiodic configurations or lattices. The overall assembly of resonator structures can include nested or concentric shells, that each include repeated patterns of resonant structures. The resonant structures can be configured as a close-packed arrangement of electrically conductive material. The resonant structures can be located on the surface of a circuit board.

The overall assemblies, as structures, do not all repeat periodically and at least some of the resonators are spaced such that their phase centers are separated by more than a wavelength. The arrangements can include resonators of several different sizes and/or geometries arranged so that each size or geometry ("grouping") corresponds to a moderate or high quality-factor "Q" response (that is, one allowing for a moderate or low bandwidth) that resonates within a specific frequency range, and that arrangement within that specific grouping of like elements is periodic in the overall structure—even though the structure as a whole is not an entirely periodic arrangement of resonators. The relative spacing and arrangement of groupings (at least one for each specific frequency range) can be defined by self similarity and origin symmetry, where the "origin" arises at the center of a structure (or part of the structure) individually designed to have the wideband metamaterial property.

For exemplary embodiments, fractal resonators can be used for the resonators because of their control of passbands, and smaller sizes. A main benefit of such resonators arises from a size standpoint because they can be used to shrink the resonator(s), while control of passbands can reduce/mitigate or eliminate issues of harmonic passbands that would resonate at frequencies not desired.

Exemplary embodiments of a resonator system for use at microwave (or nearby) frequencies can be built from belts of circuit boards festooned with resonators. These belts can function to slip the microwaves around an object located within the belts, so the object is effectively invisible and "see thru" at the microwave frequencies. Belts, or shells, having similar closed-packed arrangements for operation at a first passband can be positioned within a wavelength of one another, e.g., $1/10\lambda$, $1/8\lambda$, $1/4\lambda$, $1/2\lambda$, etc.

An observer can observe an original image or signal, without it being blocked by the cloaked object. Using no power, the fractal cloak can replicates the original signal (that is, the signal before blocking) with great fidelity. Exemplary embodiments can function over a bandwidth from about 500 MHz to approximately 1500 MHz (1.5 GHz), providing 3:1 bandwidth; operation within or near such can frequencies can provide other bandwidths as well, such as 1:1 up to 2:1 and up to about 3:1.

FIG. 1 depicts a diagrammatic plan view of a cloaking system 100 and RF testing set up in accordance with exemplary embodiments of the present disclosure. As shown in FIG. 1, a number of concentric shells (or bands) 102 are placed on a platform (parallel to the plane of the drawing). The shells include a flexible substrate (e.g., polyimide with or without composite reinforcement) with conductive traces (e.g., copper, silver, etc.) in fractal shapes or outlines. The shells 102 surround an object to be cloaked (shown as 104 in FIG. 1). A transmitting antenna 1 and a receiving antenna 2 are configured at different sides of the system 100, for verifying efficacy of the cloaking system 100 and recording results. The shells 102 can be held in place by radial supports 106 (while only four are shown, 12 were used in the exemplary embodiment indicated).

The shells indicated in FIG. 1 are of two types, one set (A1-A4) configured for optimal operation over a first wavelength/frequency range, and another set (B1-B3) configured for optimal operation over a second wavelength/frequency range. (The numbering of the shells is of course arbitrary and can be reordered, e.g., reversed.)

For an exemplary embodiment of system 100, the outer set of shells (A1-A4, with A1 being the innermost and A4 the outmost) had a height of about 3 to 4 inches (e.g., 3.5 inches) and the inner set of shells had a height of about 1 inch less (e.g., about 2.5 to 3 inches). The spacing between the shells with a larger fractal shape (A1-A4) was about 2.4 cm while the spacing between shells of smaller fractal generator shapes (B1-B3) was about 2.15 cm (along a radial direction). In a preferred embodiment, shell A4 was placed between shell B2 and B3 as shown. The resonators formed on each shell by the fractal shapes can be configured so as to be closely coupled (e.g., by capacitive coupling) and can serve to propagate a plasmonic wave.

It will be appreciated that while, two types of shells and a given number of shells per set are indicated in FIG. 1, the number of shell types and number of shells for each set can be selected as desired, and may be optimized for different applications, e.g., wavelength/frequency bands.

Figure 2:
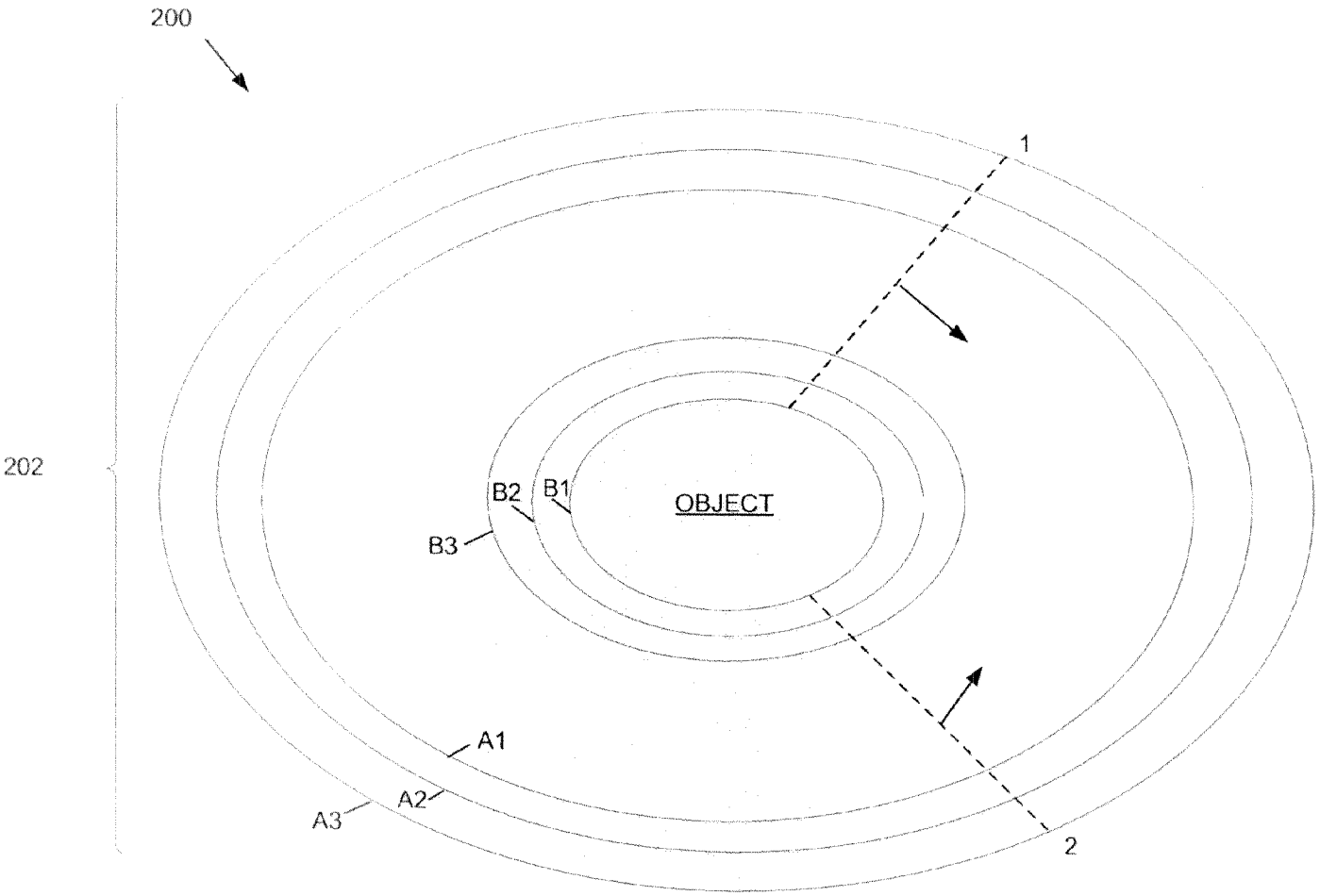
FIG. 2 depicts a diagrammatic plan view of a resonator cloaking system utilizing a number of shells having an elliptical cross-section, in accordance with an alternate embodiment of the present disclosure.

FIG. 2 depicts a diagrammatic plan view of a cloaking system (or electrical resonator system) according to an alternate embodiment in which the individual shells have an elliptical cross section. As shown in FIG. 2, a system 200 for cloaking can include a number of concentric shells (or bands) 202. These shells can be held in place with respect to one another by suitable fixing means, e.g., they can be placed on a platform (parallel to the plane of the drawing) and/or held with a frame. The shells 202 can include a flexible substrate (e.g., polyimide with or without composite reinforcement) with a close-packed arrangement of electrically conductive material formed on the first surface. As stated previously for FIG. 1, the closed-packed arrangement can include a number of self-similar electrical resonator shapes. The resonator shapes can be made from conductive traces (e.g., copper, silver, gold, silver-based ink, etc.) having a desired shape, e.g., fractal shape, split-ring shape, and the like. The shells 202 can surround an object to be cloaked, as indicated in FIG. 2.

As indicated in FIG. 2 (by dashed lines 1 and 2 and arrows), the various shells themselves do not have to form closed surfaces. Rather, one or more shells can form open surfaces. This can allow for preferential cloaking of the object in one direction or over a given angle (solid angle). Moreover, while dashed lines 1 and 2 are shown intersecting shells B1-B3 and A1-A3 of system 200, one or more shells of each group of shells (B1-B3 and A1-A3) can be closed while others are open.

With further regard to FIGS. 1-2, it should be appreciated that the cross-sections shown for each shell can represent closed geometric shapes, e.g., spherical and ellipsoidal shells.

As indicated previously, each shell of a cloaking system can include multiple resonators. The resonators can be repeated patterns of conductive traces. These conductive traces can be closed geometric shapes, e.g., rings, loops, closed fractals, etc. The resonator(s) can being self similar to at least second iteration. The resonators can include split-ring shapes, for some embodiments. The resonant structures are not required to be closed shapes, however, and open shapes can be used for such.

Figure 3:
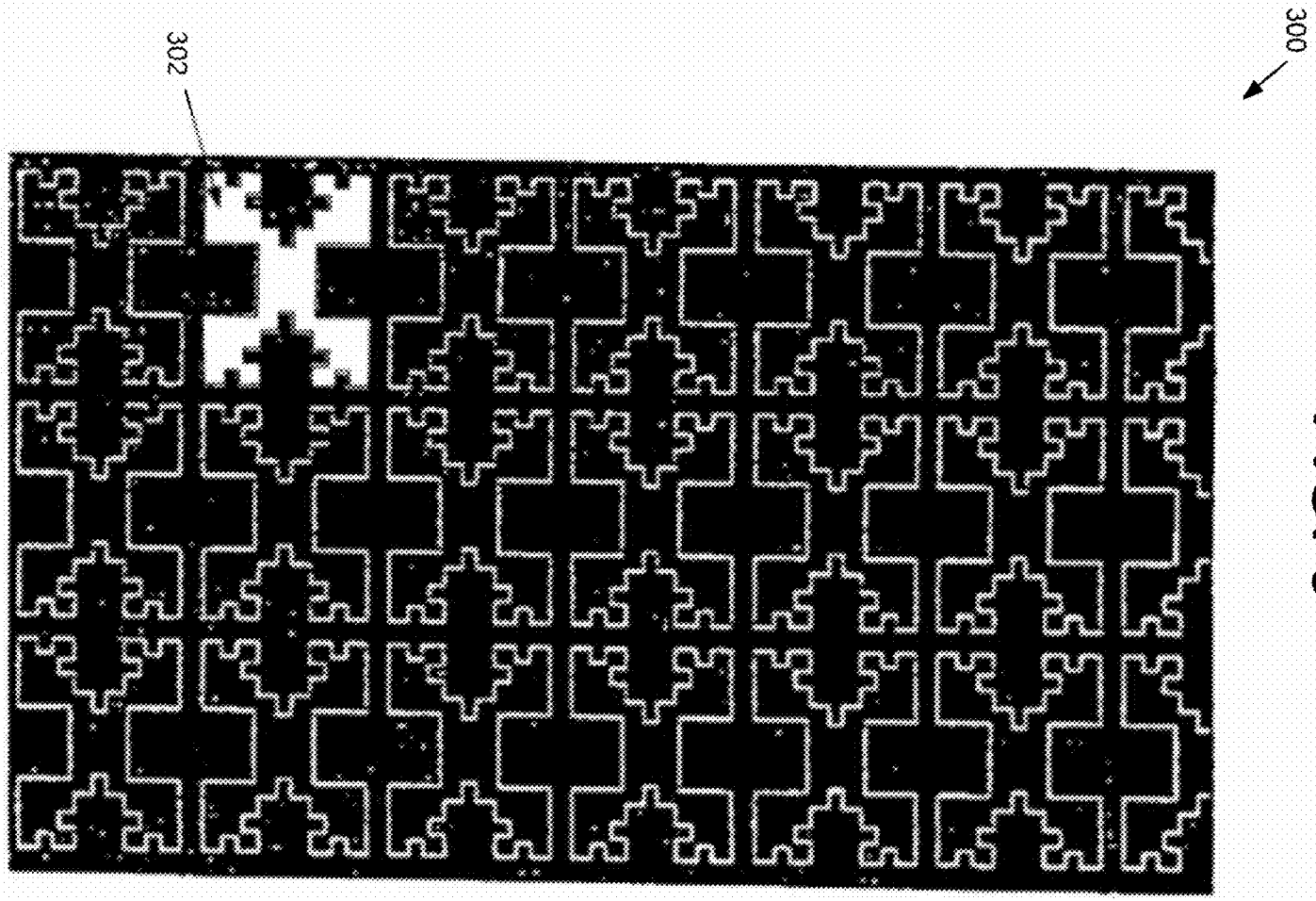
FIG. 3 depicts an exemplary embodiment of a portion of shell that includes repeated conductive traces that are configured in a fractal-like shape.

In exemplary embodiments, the closed loops can be configured as a fractals or fractal-based shapes, e.g., as depicted by 302 in FIG. 3 for an exemplary embodiment of a shell 300. The dimensions and type of fractal shape can be the same for each shell type but can vary between shell types. This variation (e.g., scaling of the same fractal shape) can afford increased bandwidth for the cloaking characteristics of the system (e.g., system 100 of FIG. 1) This can lead to periodicity of the fractal shapes of common shell types but aperiodicity between the fractal shapes of different shell types.

Examples of suitable fractal shapes (for use for shells and/or a scatting object) can include, but are not limited to, fractal shapes described in one or more of the following patents, owned by the assignee of the present disclosure, the entire contents of all of which are incorporated herein by reference: U.S. Pat. No. 6,452,553; U.S. Pat. No. 6,104,349; U.S. Pat. No. 6,140,975; U.S. Pat. No. 7,145,513; U.S. Pat. No. 7,256,751; U.S. Pat. No. 6,127,977; U.S. Pat. No. 6,476,766; U.S. Pat. No. 7,019,695; U.S. Pat. No. 7,215,290; U.S. Pat. No. 6,445,352; U.S. Pat. No. 7,126,537; U.S. Pat. No. 7,190,318: U.S. Pat. No. 6,985,122; U.S. Pat. No. 7,345,642; and, U.S. Pat. No. 7,456,799.

Other suitable fractal shape for the resonant structures can include any of the following: a Koch fractal, a Minkowski fractal, a Cantor fractal, a torn square fractal, a Mandelbrot, a Caley tree fractal, a monkey's swing fractal, a Sierpinski gasket, and a Julia fractal, a contour set fractal, a Sierpinski triangle fractal, a Menger sponge fractal, a dragon curve fractal, a space-filling curve fractal, a Koch curve fractal, an lypanov fractal, and a Kleinian group fractal.

FIG. 3 depicts an exemplary embodiment of a shell 300 (only a portion is shown) that includes repeated conductive traces that are configured in a fractal shape 302 (the individual closed traces). For the exemplary embodiment shown, each resonator shape 302 is about 1 cm on a side. Such resonator could, e.g., be used for the fractal shapes of shells B1-B3 of FIG. 1, in which case similar fractal shapes of larger size (e.g., about 1.5 cm on a side) could be used for shells A1-A4. The conductive trace is preferably made of copper. While exemplary fractal shapes are shown in FIG. 3, the present disclosure is not limited to such and any other suitable fractal shapes (including generator motifs) may be used in accordance with the present disclosure.

It will be appreciated that the resonant structures of the shells may be formed or made by any suitable techniques and with any suitable materials. For example, semiconductors with desired doping levels and dopants may be used as conductive materials. Suitable metals or metal containing compounds may be used. Suitable techniques may be used to place conductors on/in a shell, including, but no limited to, printing techniques, photolithography techniques, etching techniques, and the like.

It will also be appreciated that the shells may be made of any suitable material(s). Printed circuit board materials may be used. Flexible circuit board materials are preferred. Other material may, however, be used for the shells and the shells themselves can be made of non-continuous elements, e.g., a frame or framework. For example, various plastics may be used.

Figure 4:
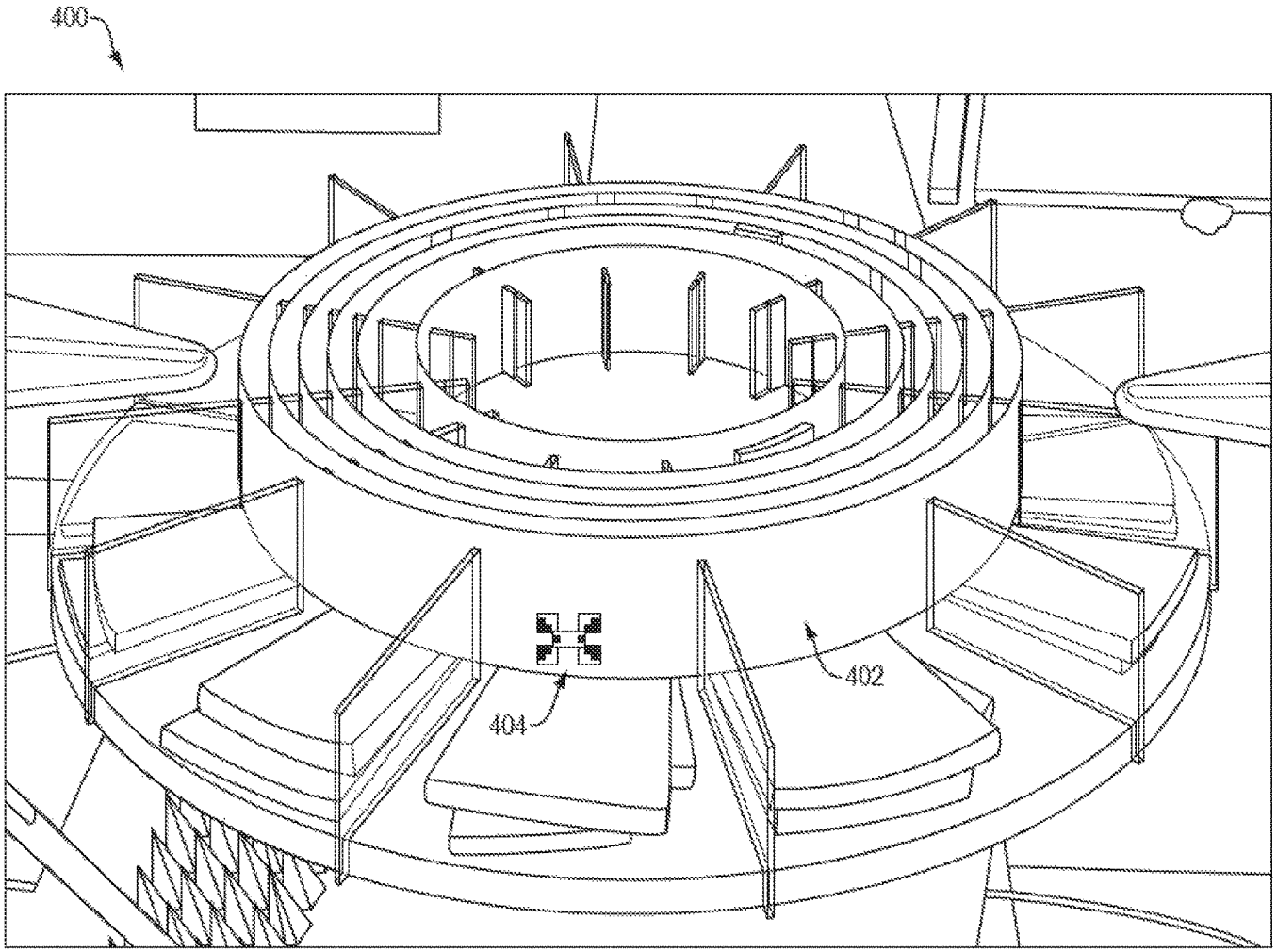
FIG. 4 depicts a perspective view (photograph) of an exemplary embodiment of the present disclosure.

FIG. 4 depicts a perspective view (photograph) of an exemplary embodiment of a cloak system 400 according to the present disclosure. As shown, the system includes a number of resonator shells 402 each having a close-packed arrangement of electrically conductive material (self-similar resonators) formed on one surface. Two different shell configurations are shown, four larger shells and two smaller shells. The smaller shells included close-packed arrangements of resonator structures in which each resonator shape (as shown by 302 in FIG. 3) was about 1 cm on a side. Similar fractal shapes of larger size (e.g., about 1.5 cm on a side) were used for the larger shells.

In FIG. 4, a transmitting (source) antenna and a receiving antenna are shown as triangular shapes on the left and right, respectively (though functionally of each could of course be interchanged for the other). Twelve radially arrayed spacers are shown in FIG. 4. The system 400 is shown supported on a Nalgene tank and Delrin platform and Delrin supports (radial supports) RF absorbers were placed in the immediate vicinity of the set up; further RF tripods (e.g., available from ETS) were used; all such materials were substantially transparent at the RF frequencies investigated/used. The cloak system 400 consists of six belts of fractal metamaterial (i.e., fractal-resonant structures shown in FIG. 3) on flexible Taconic EF35 (low loss) circuit board. The belts are shown surround a scattering ring (object). The arrangement is supported by RF transparent plastics in a comb support. The entire system 400 was shown to be easily built up and broken down within a minute or two. The scale in FIG. 4 is about 0.7 meters across. The height of each shell can of course be selected as desired depending on the situation/application.

While embodiments are shown and described herein as having shells in the shape of concentric rings (circular cylinders), shells can take other shapes in other embodiments. For example, one or more shells could have a generally spherical shape (with minor deviations for structural support). In an exemplary embodiment, the shells could form a nested arrangement of such spherical shapes, around an object to be shielded (at the targeted/selected frequencies/wavelengths). Shell cross-sections of angular shapes, e.g., triangular, hexagonal, while not preferred, may be used.

One skilled in the art will appreciate that embodiments and/or portions of embodiments of the present disclosure can be implemented in/with computer-readable storage media (e.g., hardware, software, firmware, or any combinations of such), and can be distributed and/or practiced over one or more networks. Steps or operations (or portions of such) as described herein, including processing functions to derive, learn, or calculate formula and/or mathematical models utilized and/or produced by the embodiments of the present disclosure, can be processed by one or more suitable processors, e.g., central processing units ("CPUs) implementing suitable code/instructions in any suitable language (machine dependent on machine independent).

While certain embodiments and/or aspects have been described herein, it will be understood by one skilled in the art that the methods, systems, and apparatus of the present disclosure may be embodied in other specific forms without departing from the spirit thereof.

For example, while certain wavelengths/frequencies of operation have been described, these are merely representative and other wavelength/frequencies may be utilized or achieved within the scope of the present disclosure.

Furthermore, while certain preferred fractal generator shapes have been described others may be used within the scope of the present disclosure. Accordingly, the embodiments described herein are to be considered in all respects as illustrative of the present disclosure and not restrictive.

What is claimed is:

1. An electrical resonator system, comprising:

a plurality of concentric electrical resonator shells, each shell including a substrate having first and second surfaces and a close-packed arrangement of electrically conductive material formed on the first surface, wherein the closed-packed arrangement comprises a plurality of self-similar electrical resonator shapes and is configured to operate at a desired passband of electromagnetic radiation; and wherein at least some of the resonator shapes consists of geometric shapes that are not self-similar;

wherein the system is further configured to obscure an object or objects using the plurality of concentric resonator shells to divert the incident radiation around the object or objects and make the radiation propagate to the antipodes of the incident point.

2. The system of claim 1, wherein the plurality of concentric resonator shells surround the object or objects.

* * * * *